US008499981B2

(12) United States Patent
Quinlan et al.

(10) Patent No.: US 8,499,981 B2
(45) Date of Patent: Aug. 6, 2013

(54) BIFURCATED STEM FOAM PUMP

(75) Inventors: Robert L. Quinlan, Stow, OH (US); Mark E. Rosenkranz, Medina, OH (US); Aaron R. Reynolds, North Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/280,057

(22) Filed: Oct. 24, 2011

(65) Prior Publication Data

US 2012/0074171 A1 Mar. 29, 2012

Related U.S. Application Data

(63) Continuation-in-part of application No. 12/069,214, filed on Feb. 8, 2008, now Pat. No. 8,047,403, and a continuation-in-part of application No. 12/069,320, filed on Feb. 8, 2008, now Pat. No. 8,047,404, and a continuation-in-part of application No. 12/069,321, filed on Feb. 8, 2008, now Pat. No. 8,313,010.

(51) Int. Cl.
*B67D 7/76* (2010.01)

(52) U.S. Cl.
USPC ..... 222/190; 222/136; 222/145.5

(58) Field of Classification Search
USPC ..... 222/321.7, 321.9, 401, 190, 136, 222/145.5
See application file for complete search history.

(56) References Cited

U.S. PATENT DOCUMENTS

| | | | |
|---|---|---|---|
| 4,880,161 | A | 11/1989 | Wright |
| 4,957,218 | A | 9/1990 | Ford, Jr. |
| 5,222,633 | A | 6/1993 | Blake |
| 5,372,281 | A | 12/1994 | Palmer et al. |
| 5,411,177 | A | 5/1995 | Blake, III |
| 5,445,288 | A | 8/1995 | Banks |
| 5,752,627 | A | 5/1998 | Vandromme et al. |
| 5,779,104 | A | 7/1998 | Reidel |
| 5,984,146 | A | 11/1999 | Kaufman |
| 6,082,586 | A | 7/2000 | Banks |

(Continued)

FOREIGN PATENT DOCUMENTS

| | | |
|---|---|---|
| CA | 2465055 | 6/2005 |
| WO | 99/49769 | 10/1999 |

OTHER PUBLICATIONS

Extended European Search Report and Written Opinion for European Application No. 12158630.9, Dated Mar. 26, 2012.

(Continued)

*Primary Examiner* — Paul R Durand
*Assistant Examiner* — Donnell Long
(74) *Attorney, Agent, or Firm* — Calfee, Halter & Griswold LLP

(57) ABSTRACT

Foam dispensers having a housing and an air compressor connected to the housing are disclosed herein. The air compressor releasably mates with a refill unit. The refill includes a container and liquid pump housing. The liquid pump housing includes: a liquid reservoir; an inlet valve; an outlet valve; an air inlet opening through the liquid pump housing; a foaming screen; and a foam dispensing nozzle secured to the liquid pump housing. The liquid pump housing is configured to releasably mate with an air compressor that is not part of the refill unit but is secured to a foam pump dispenser housing, and the refill unit is configured to be removed from the foam dispenser without removing the air compressor from the foam dispenser.

20 Claims, 6 Drawing Sheets

U.S. PATENT DOCUMENTS

| | | | | |
|---|---|---|---|---|
| 6,612,468 | B2 | 9/2003 | Pritchett et al. | |
| 7,325,704 | B2 * | 2/2008 | Kasting | 222/321.4 |
| 7,389,893 | B2 * | 6/2008 | Kasting | 222/321.4 |
| 7,641,077 | B2 * | 1/2010 | Law et al. | 222/190 |
| 7,661,561 | B2 * | 2/2010 | Ophardt et al. | 222/137 |
| 7,708,166 | B2 * | 5/2010 | Ophardt | 222/190 |
| 7,780,039 | B2 * | 8/2010 | Criswell et al. | 222/108 |
| 7,802,701 | B2 * | 9/2010 | Jahan et al. | 222/153.13 |
| 7,819,289 | B2 * | 10/2010 | Willis | 222/190 |
| 7,950,548 | B2 * | 5/2011 | Ciavarella et al. | 222/181.3 |
| 2005/0072805 | A1 | 4/2005 | Matthews | |
| 2006/0273114 | A1 | 12/2006 | Ophardt | |
| 2007/0023454 | A1 | 2/2007 | Ophardt | |
| 2008/0083783 | A1 | 4/2008 | Nelson | |
| 2008/0083784 | A1 | 4/2008 | Foster et al. | |
| 2009/0184137 | A1 | 7/2009 | O'Brien | |

OTHER PUBLICATIONS

International Search Report and the Written Opinion from International Application No. PCT/US20091000725, dated of mailing May 11, 2009; 12 pages.

European Search Report and Written Opinion dated Oct. 28, 2009; EP Application No. 09152143.5.

European Search Report and Written Opinion dated Sep. 16, 2011; EP Application No. 11172819.2.

* cited by examiner

BIFURCATED STEM FOAM PUMP

RELATED APPLICATIONS

This application is a continuation-in-part of U.S. patent application Ser. No. 12/069,214, titled Bifurcated Stem Foam Pump, which was filed on Feb. 8, 2008 and will issue as U.S. Pat. No. 8,047,403 on Nov. 2, 2011. This application is also a continuation-in-part of U.S. patent application Ser. No. 12/069,321, titled Bifurcated Foam Pump Assembly, which was filed on Feb. 8, 2008. This application is a continuation-in-part of U.S. patent application Ser. No. 12/069,320, titled Bifurcated Stem Foam Pump, which was also filed on Feb. 8, 2008 and will issue as U.S. Pat. No. 8,047,404 on Nov. 2, 2011. This application claims priority to and the benefits of these three applications which are incorporated herein by reference.

TECHNICAL FIELD

Embodiments of the invention herein reside in the art of liquid dispensing mechanisms and, more particularly, to those mechanisms that are particularly adapted for dispensing a liquid in the form of a foam. Specifically, the embodiments relate to the foam pump generators for such dispensers, and particularly one that is bifurcated or separable between the liquid pump portion and the air pump portion. Specifically, the embodiments relate to foam pumps that allow the liquid pump portion to be fixed to and a part of the disposable refill cartridge containing the liquid, and in which the air pump or compressor portion is a non-disposable portion secured to the dispenser housing.

BACKGROUND OF THE INVENTION

For many years, it has been known to dispense liquids such as soaps, sanitizers, cleansers, disinfectants, and the like from a dispenser housing maintaining a removable and replaceable cartridge containing the liquid. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam, generated by the interjection of air into the liquid, generating the formation of bubbles thereby. Accordingly, the standard liquid pump has given way to a foam generating pump, which necessarily requires means for combining the air and liquid in such a manner as to generate the desired foam. However, foam generating pumps are more expensive than liquid dispensing pumps, necessarily increasing the cost of disposable cartridges that include the pump with each cartridge.

Typically, foam pumps include an air compressor portion and a fluid passing portion—the two requiring communication to ultimately create the foam. The portion required for compressing the air is not given to wear and degradation to the extent of the portion required for passing the liquid and generating the foam from the combination of liquid and air. Accordingly, it has been determined that there is no necessity for replacing the air compressor, but only the liquid pumping and foam generating portion of the pump when replacement of the cartridge is necessary. Accordingly, a bifurcation of the pump has been determined to be possible and desirable.

SUMMARY

Embodiments of foam dispensers including a housing, an air compressor connected to the housing and an actuator for actuating the air compressor are disclosed herein. The air compressor releasably mates with a refill unit. The dispenser has an "empty state" and a "refilled state." The empty state occurs when there is not a refill unit positioned in the dispenser, and the refilled state occurs when the refill unit is positioned in the dispenser. The air compressor remains connected to the housing during the refilled state and remains connected to the housing during the empty state. In addition, embodiments of refill units for the foam dispenser are also disclosed herein. One refill unit for a foam pump dispenser includes a container for containing a foamable liquid and liquid pump housing connected to the container. The liquid pump housing includes: a liquid reservoir; an inlet valve; an outlet valve; an air inlet opening through the liquid pump housing; a foaming screen; and a foam dispensing nozzle secured to the liquid pump housing. The liquid pump housing is configured to releasably mate with an air compressor that is not part of the refill unit but is secured to a foam pump dispenser housing, and the refill unit is configured to be removed from the foam dispenser without removing the air compressor from the foam dispenser. The air inlet passage is in fluid communication with the atmosphere prior to being installed in a foam dispenser and the air inlet passage is in fluid communication with an air compressor when the refill unit is placed in the foam dispenser.

BRIEF DESCRIPTION OF DRAWINGS

For a complete understanding of the aspects, structures and techniques of the invention, reference should be made to the following detailed description and accompanying drawings wherein.

DETAILED DESCRIPTION

Figure 1:
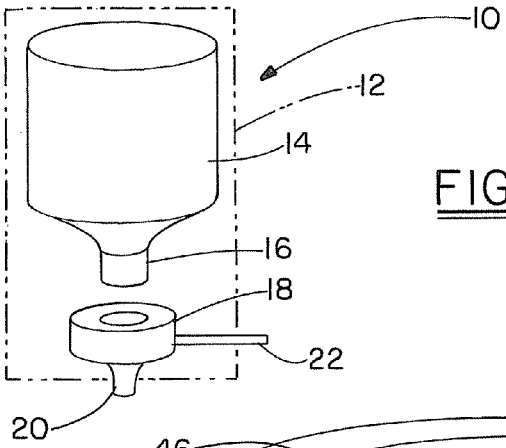
FIG. 1 is an illustrative functional view of a bifurcated stem foam pump made in accordance with embodiments of the present invention.

Referring now to the drawings and more particularly FIG. 1, it can be seen that a foam solution dispenser employing the bifurcated foam pump assembly of the invention is designated generally by the numeral 10. It will be appreciated that the foam solution dispenser may be of any of various types, adapted for dispensing soap, lotion, sanitizers, cleaners or the like in the form of a foam. The dispenser 10 includes a housing 12, typically of molded plastic or the like. The housing 12 defines a cavity which is adapted to receive a bottle or cartridge 14 of liquid of the particular type required for generating the desired foam. The bottle or cartridge 14 is nestingly received by the housing 10 and, may be received and contained by supporting brackets, collars and the like within the housing 12.

A liquid pump 16 is connected to and provided as a portion of the disposable refill cartridge or bottle 14. In contradistinction, an air compressor unit 18 is provided as part and parcel of the dispenser housing 12. In one embodiment of the invention, the air compressor 18 includes a dispensing nozzle 20, through which the generated foam is dispensed onto the hand of the user, utensil or otherwise. However, preferably, any portion that contacts liquid or foam is part and parcel of the disposable refill unit or cartridge.

A suitable actuator 22 is operatively connected to the air compressor 18 to achieve actuation of the foam generator comprising the combination of the liquid pump 16 and air compressor 18. Those skilled in the art will understand that foam is typically generated from a combination of air and liquid, with the two being forced together, agitated, stirred, forcefully blended or the like. The actuator 22 may be either manually actuated as in the case of a lever, push bar or the like, or it may be electronically or optically actuated as in the implementation of touch free dispensers.

It will be appreciated that a concept of the invention, and as particularly presented below, is the implementation and utilization of a bifurcated foam pump assembly, in which the liquid pump portion is attached to and made a portion of the disposable and replaceable cartridge 14 containing the liquid ingredient of the foam solution, while the air compressor 18 and associated nozzle 20 are not disposable, but remain a portion of the dispenser housing 12. However, many concepts of the invention have the nozzle 20 connected to the disposable refill bottle or cartridge 14.

Figure 2:
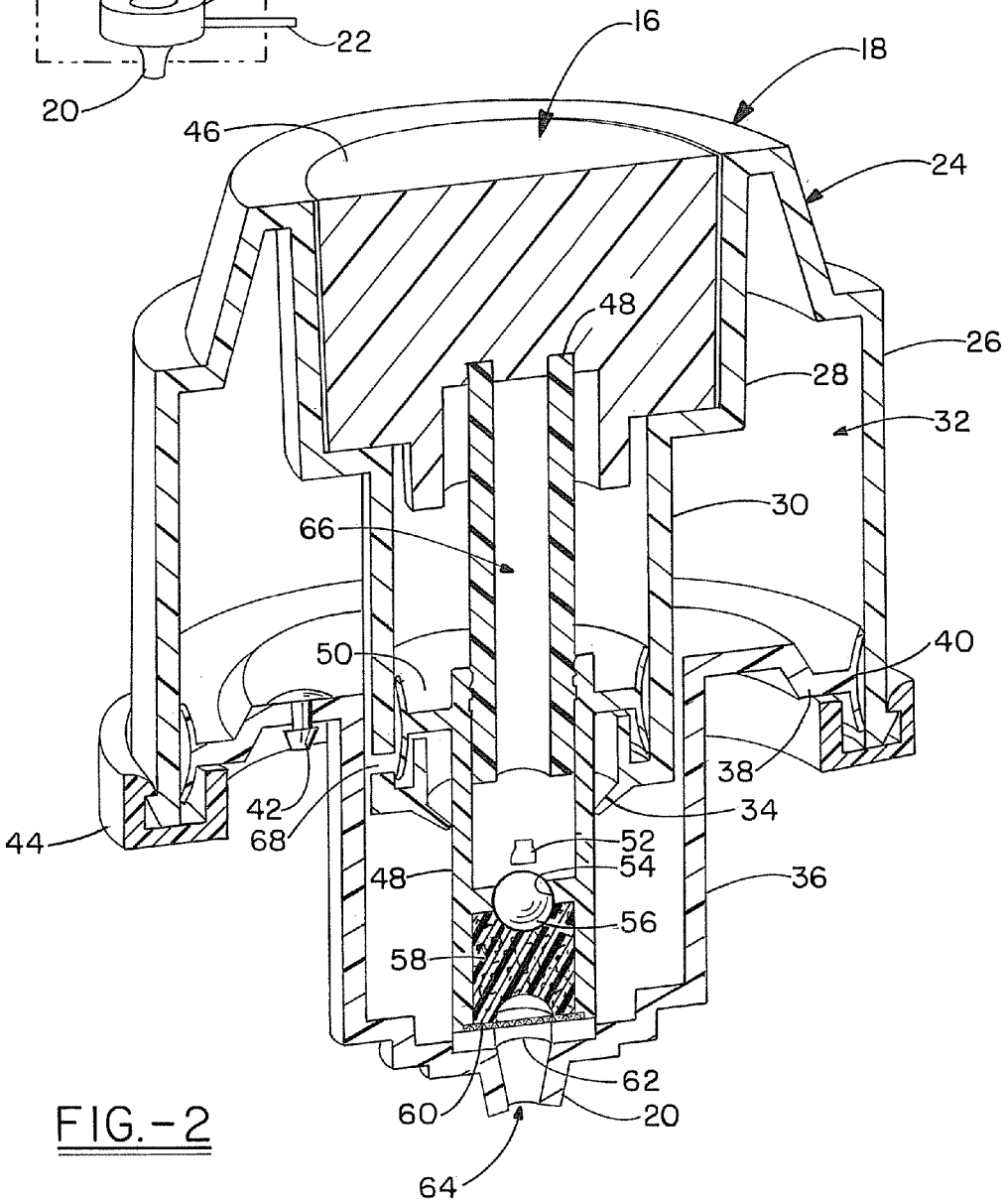
FIG. 2 is a cross sectional view of a bifurcated stem foam pump made in accordance with embodiments of the present invention.

With reference now to FIG. 2, an appreciation can be obtained regarding the specific structure and interrelationships of the liquid pump 16 and the air compressor 18 embodied in the bifurcated pump of one embodiment of the present invention. Specifically, with regard to the air compressor 18 and nozzle 20, which constitute a fixed permanent part of the housing 12 of the dispenser 10, it will be appreciated that a primary portion thereof is an annular collar 24. The collar 24 consists of an outer ring 26 interconnected with an inner ring formed from a first inner wall 28 interconnected with a second inner wall 30. As shown, an annular cavity 32 is defined between the outer ring 26 and the inner ring comprised of the first and second inner walls 28, 30. The cavity 32 establishes the air chamber which is employed as a portion of the air compressor of the invention. A seal ring 34 extends from a bottom portion of the second inner wall 30 and defines an annulus that receives the stem of the liquid pump of the invention and serves as a seal as the piston thereof moves to effect dispensing, as will be discussed below.

An air piston 36 is received by the outer ring 26 and is reciprocatingly movable within the cavity 32 to effect operation of the air compressor. The air piston 36 includes a top annular disk 38 having a circumferential seal 40 extending thereabout. The seal 40 engages the inner wall surface of the outer ring 26, as shown. A one-way check valve or button valve 42 is provided within an aperture of the top annular disk 38 to allow air to enter the cavity or air chamber 32 during operation, as will become apparent below.

It will be appreciated that a spring (not shown) may be maintained within the cavity 32 and interposed between the top annular disk 38 and the annular collar 24 to bias the two away from each other toward a position maximizing the volume of the cavity of the air chamber 32. Embodiments of the invention contemplate either an interior spring, exterior spring or other type of biasing structure, readily perceivable by those skilled in the art, for implementation with the invention.

The annular collar 24 is received by a mounting ring 44 which is part and parcel of the dispenser housing 12. Similarly, the mounting ring 44 provides a stop for the top annular disk 38 during operation. As presented above, the air compressor and nozzle 18, 20 are contemplated to be a fixed permanent portion of the dispenser housing and, to the extent there received and maintained by the mounting ring 44, and comprise a portion of the dispenser housing. However, nozzle 20 may be part of the disposable refill unit.

Embodiments of the present invention contemplate that the liquid pump may be a conventional stem-type pump, frequently used in the dispensing of various fluids. The liquid pump 16 includes a reservoir collar 46 received by the annular collar 24 and connected to the disposable and replaceable cartridge 14 and forming therewith liquid reservoir 66. The reservoir collar 46 receives a hollow valve stem 48 that extends from the reservoir collar 46 downwardly to the nozzle 20, when the pump 16 is placed into the air compressor 18. As with conventional liquid pumps, a one-way inlet valve may be included to allow liquid to enter valve stem 48. A sealing flange 50 extends radially outwardly from the hollow valve stem 48 and makes sealing engagement with the inner surface of the second wall 30, as shown. As illustrated, the interior of the second wall 30 defines an extension of the liquid reservoir cavity defined by the reservoir collar 46. The sealing flange 50 moves axially within the liquid reservoir cavity with the valve stem 48 to reduce the volume of the cavity, thus forcing liquid within the cavity through the hollow valve stem in a customary manner.

The hollow valve stem 48 includes a check valve 52 in an aperture passing therethrough. Further, the valve stem 48 includes an inner extending annular ring forming a valve seat 54, as shown. A ball valve 56 is in operative engagement with the valve seat 54 and biased there-against by means of a sponge, screen, mesh or the like 58. The element 58 serves to assist in the generation of foam by receiving and passing liquid and air therethrough. In any event, it is preferred that the element 58 be resilient, serving as both a foam generating member and a valve biasing member, urging the ball valve 56 into sealing engagement with the valve seat 54. As can be seen with respect to FIG. 1 and FIG. 2, the opening in the hollow valve stem 48, through which check valve 52 is placed is in fluid communication with the atmosphere (FIG. 1) when the refill unit is not mated with the air compressor portion 18 and is in fluid communication with compressor 18 (FIG. 2) when the refill unit and liquid pump 16 are mated together.

A final screen 60 extends across an outlet aperture 62 at the end of the hollow valve stem 48, as shown. An outlet passage 64 extends axially from the nozzle 20. As illustrated, an air aperture 68 passes through the second wall 30 of the inner ring defining the air chamber 32.

It will be appreciated that the liquid pump 16, comprising primarily the elements 46-66 just described, is part and parcel of the disposable cartridge 14, filled with appropriate liquid or the like. The liquid pump assembly 16 is inserted into and received by the air compressor 18, which is a fixed portion of the dispenser housing 12. Of course, appropriate seals are provided on the pump 16 and/or compressor 18 to effect this mating engagement.

In operation, the air chamber or cavity 32 is filled with air and the hollow stem valve 48 and associated liquid reservoir 66, in communication with the interior of the cartridge 14, is filled with appropriate liquid. When the actuator 22 is engaged, the air piston 36 is driven upwardly into the air chamber 32, compressing the air therein and urging it through the aperture 68 and into the area surrounding the valve stem 48 as it moves upwardly within the sealing ring 34. With this upward movement, the liquid within the container 14 and reservoir 66 is driven through the hollow stem valve 48 downwardly against the ball valve 56, unseating it from the seat 54. The check valve 52 prevents the liquid from otherwise escaping from the hollow stem 48.

When the check valve 52 travels beyond the seal ring 34, the compressed air from the air chamber 32 passes through the check valve 52 and into the hollow valve stem 48, further driving the ball valve 56 from the seat 54 and into the sponge, screen, mesh or the like 58. Accordingly, with continued movement of the piston 36, liquid and air are driven past the ball valve 56 and through the element 58 by which the air and liquid are sufficiently mixed to form a foam that is extruded through the screen 62 and out the passage 64 of the nozzle 20.

At the end of the dispensing stroke, as determined by the actuator 22 or otherwise, an appropriate biasing member urges return of the air piston 36. Upon such urging, the one-way check valve or button valve 42 opens, allowing air to return into the air chamber 32. Similarly, the element 58 urges the ball valve 56 into engagement with the valve seat 54 to preclude any further passage of liquid to the element 58. With the hollow valve stem 48 urged by a spring or other biasing member toward the air piston 36, the hollow valve stem 48 is repositioned for the next dispensing cycle.

Thus, it can be appreciated that the aspects of the invention have been achieved by the structure presented above. The fluid pump of the invention can be a commonly available fluid pump requiring minimal if any modification. The fluid pump is fixedly attached to and remains a portion of the disposable liquid cartridge 14. Since the liquid pump is primarily in gravity-effected nesting engagement with the air compressor 18, removal and replacement of the cartridge 14 is easily achieved. Moreover, the liquid pump can be manufactured of inexpensive materials, with the only requirement that it perform satisfactorily for the number of dispensing cycles required to deplete the cartridge 14. On the other hand, the air compressor portion of the invention is an integral and permanent portion of the dispenser housing, and is capable of repeated use through numerous refills and replacements of the cartridge 14.

Figure 3:
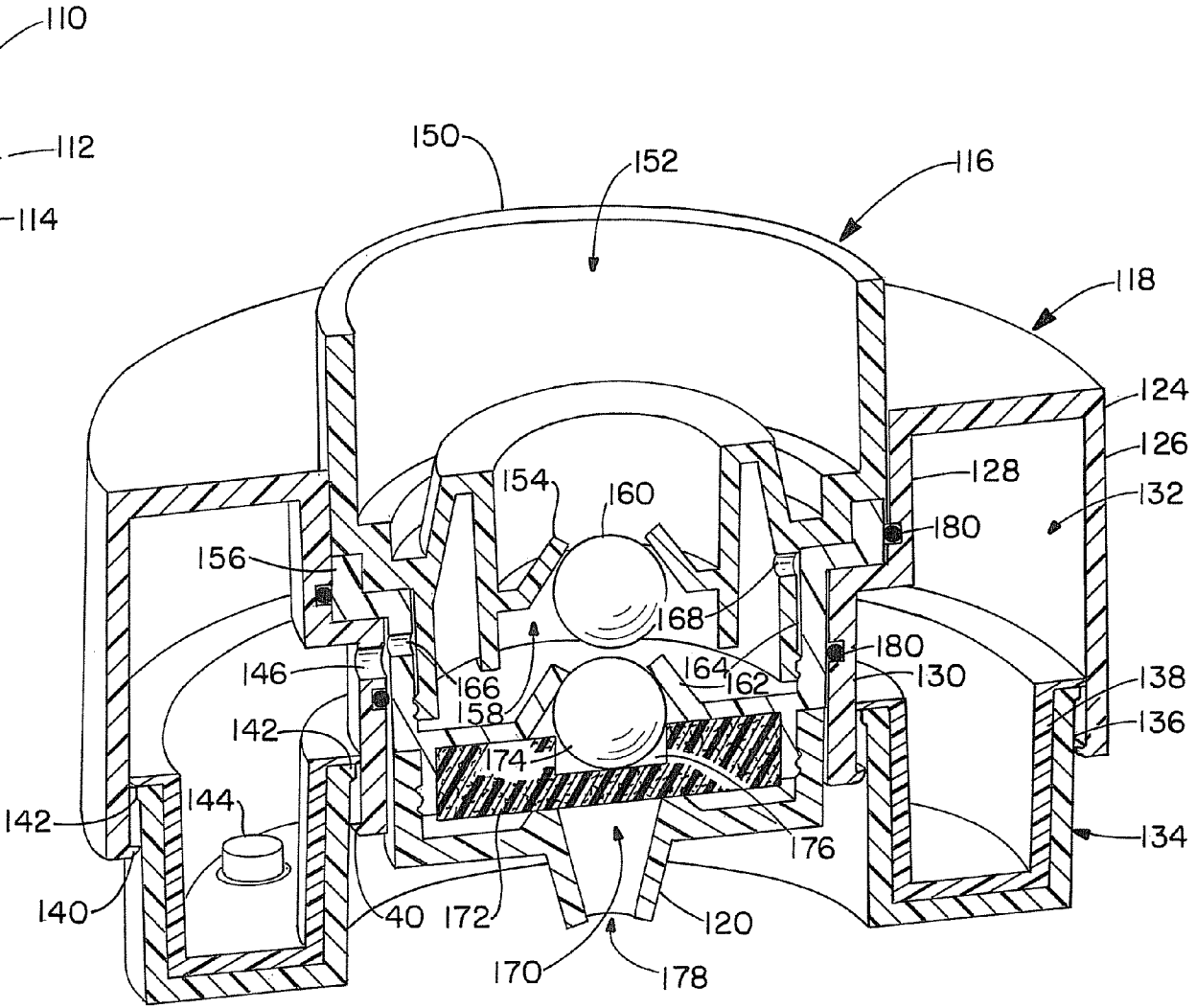
FIG. 3 is an illustrative view of a dispenser and liquid cartridge employing a bifurcated foam pump assembly made in accordance with embodiments of the present invention.

Referring now to FIG. 3, another bifurcated foam pump assembly of an embodiment of the present invention is designated generally by the numeral 110. The dispenser may be of any of various types, adapted for dispensing soap, lotion, sanitizers, cleaners or the like in the form of a foam. The dispenser 110 includes a housing 112, typically of molded plastic or the like. The housing 112 defines a cavity which is adapted to receive a bottle or cartridge 114 of a set volume of a liquid of the particular type required for generating the desired foam. The bottle or cartridge 114 is nestingly received by the housing 110 and may be received and contained by supporting brackets, collars and the like within the housing 112.

A liquid pump 116 is connected to and provided as a portion of the disposable refill cartridge or bottle 114. In contradistinction, an air compressor unit 118 is provided as part and parcel of the dispenser housing 112. Alternatively, the air compressor 118 or the liquid pump 116 may include a dispensing nozzle 120, through which the generated foam is dispensed onto the hand of the user, utensil or otherwise.

A suitable actuator 122 is operatively connected to the air compressor 118 to achieve actuation of the foam generator comprising the combination of the liquid pump 116 and air compressor 118. Those skilled in the art will understand that foam is typically generated from a combination of air and liquid, with the two being forced together, agitated, stirred, forcefully blended or the like. The actuator 122 may be either manually actuated as in the case of a lever, push bar or the like, or it may be electronically or optically actuated as in the implementation of touch free dispensers.

It will be appreciated that a concept of the invention, as particularly presented below, is the implementation and utilization of a bifurcated foam pump assembly, in which the liquid pump portion is attached to and made a portion of the disposable and replaceable cartridge 114, containing the liquid ingredient of the foam solution, while the air compressor 118 and associated nozzle 120 are not disposable, but remain a portion of the dispenser housing 112.

Figure 4:
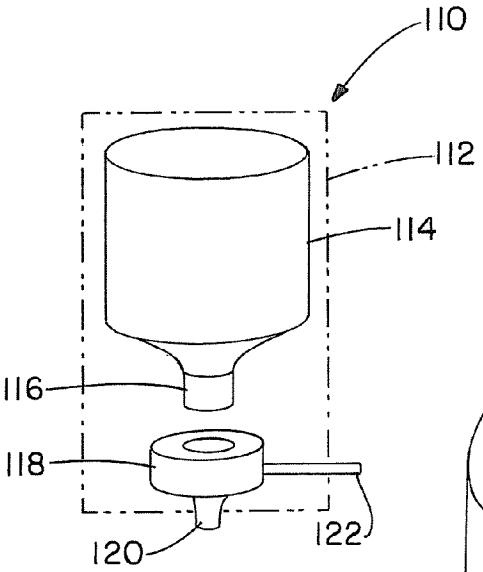
FIG. 4 is a cross sectional view of a bifurcated foam pump assembly made in accordance with embodiments of the present invention.

Referring now to FIG. 4, an appreciation can be obtained of a bifurcated liquid pump and air compressor assembly, and wherein the two are shown in the operative engagement achieved when the replaceable cartridge 114 with liquid pump 116 attached thereto is matingly received by the air compressor 118 and attached nozzle 120 that are received by and maintained as a portion of the dispenser housing 112. As can be seen in FIG. 4, the air compressor 118 includes an annular collar 124 that is formed from an outer ring 126 and an inner ring established by first and second stepped walls 128, 130. A cavity 132 is defined between the outer ring 126 and the inner ring formed by the interconnected walls 128, 130. A piston 134, consisting of an outer piston sleeve 136 and an inner piston sleeve 138 is received within the cavity 132 of the annular collar 124 and is adapted to operate between the outer ring 126 and one of the stepped inner rings 130. As will be readily appreciated by those skilled in the art, the piston assembly 134 is adapted for reciprocation within the cavity 132. The extending motion of the piston 134 is limited by stops 140, 142 of the annular collar 124 and piston assembly 134, as shown. It will also be appreciated that the inward compressive movement of the piston 134 may be limited in various similar ways, including a limitation on the movement of the actuator 122.

A one-way inlet valve 144 is provided in a base portion of the piston 134, to allow air to reenter the air chamber or cavity 132 during operation, as will become apparent herein. It will also be noted that an outlet aperture 146 is provided in the wall 130 of the annular collar 124, to allow communication between the air chamber or cavity 132 and the liquid pump assembly, as will be discussed below.

With continued reference to FIG. 4, it can be seen that the liquid pump 116 includes a collar 150 which is appropriately received by the throat of the disposable cartridge or container 114. The collar defines a cavity 152 and is characterized by an upwardly extending truncated conical valve seat 154 at a bottom portion thereof, as shown. The various ribs and rings illustrated as comprising a portion of the collar 150 are primarily interposed for purposes of strength and rigidity as will be readily appreciated by those skilled in the art. According to a preferred embodiment of the invention, the collar 150, as with the majority of the components of the invention, are molded of an appropriate plastic.

An intermediate cap 156 is attached to and closes an end of the collar 150 to define a liquid dispensing cavity 158 therebetween. A ball valve 160 is received within the cavity 158 and is adapted to sealingly nest with the valve seat 154 during operation. Ball valves 160, 174 may be hollow to increase buoyancy and further urge ball valves 160, 174 against seats 154, 164. A second valve seat 162, again of a truncated conical nature, is formed as part and parcel of the intermediate cap 156, as shown, and operates as the seat for an outlet valve, as will become apparent below.

An annular recess or cavity 164 is provided about the interior wall surface of the cap 156 to provide a ring-like passage between an aperture 166 provided through the wall of the cap 156 and the aperture 168 provided through the wall of the collar 150. Accordingly, there is a passage for communication between the air chamber cavity 132 and the liquid chamber cavity 158 through the apertures 146, 166 and 168, by means of the annular recess or passage 164. As can be seen with respect to FIG. 3 and FIG. 4, apertures 168 are in fluid communication with the atmosphere (FIG. 3) when the refill unit is not mated with the air compressor portion 118 and are in fluid communication with compressor 118 (FIG. 2) when the refill unit and liquid pump 116 are mated together.

A nozzle 120 is received by and closes the end of the intermediate cap 156, as shown in FIG. 4. A cavity 170 is thus defined between the nozzle 120 and the intermediate cap 156. This outlet chamber or cavity 170 receives an appropriate sponge, screen, mesh assembly or the like to assist in the generation of foam as a mixture of air from the air chamber or cavity 132 and liquid from the liquid chamber or cavity 158. A ball valve 174 is received by the cavity 170 and is urged by the resilient nature of the sponge, screen, or mesh assembly 172 into nesting sealing engagement with the valve seat 162, at rest. For this purpose, an appropriate recess 176 may be provided in the element 172.

It will be appreciated that the elements comprising the liquid pump 116 are attached to and are a part of the refill cartridge 114 and are received by the annular collar 124 and the remainder of the air chamber or compressor 118 when replacement of the refill cartridge 114 is effected. To that end, appropriate O-ring seals 180 are received within the first and second walls 128, 130 of the inner ring of the collar 124. This allows for and ensures that the passage of liquid from the container 114 only occurs after it is converted to foam for dispensing through the outlet 178 of the nozzle 122.

In operation, the liquid of the cartridge 114 that is required for generating the desired foam passes from the container 114 through the cavity 152 of the collar 150 and, by gravity, passes the seat and ball valve arrangement 154, 160 and flows into the liquid cavity 158 to await a dispensing operation. The seat and ball valve 162, 174 is closed at this time due to the biasing nature of the element 172. When a dispensing operation is initiated as by the actuator 122, the piston 134 moves from engagement between the stops 140, 142 and begins to compress air within the air chamber or cavity 132, forcefully passing that air through the apertures 146, 166, annular recess or passage 164, and through the aperture 168 and into the liquid chamber 158. This compressed air forces the ball valve 160 into sealing engagement with the valve seat 154 and urges the ball valve 174 to disengage from the seat 162 against the biasing of the screen, sponge or mesh 172. A mixture of air and liquid is then forced through the valve assembles 162, 174 and through the foam generating member 172 such that an appropriate foam is emitted through the outlet 178 and onto the hands of the user or a desired tool or implement. At the end of the dispensing cycle, appropriate springs or biasing devices in the actuator 122 cause the piston 134 to retract from the cavity 132 until contact is made between the stops 140, 142. During this activity, air is drawn through the one-way valve 144 into the expanding cavity 132 to await the next cycle of operation. Liquid is replenished from the container 114 through the valve assembly 154, 160 by gravity, until the cavity 158 is replenished. The bifurcated foam pump assembly comprising the liquid pump 116 and the air compressor 118 then awaits the next dispensing cycle.

Only the liquid portion of the foam generator is required for replacement upon depletion of the cartridge 114, rather than total replacement of the assembly as with prior art devices. Additionally, the bifurcated foam pump assembly is reliable and durable in use, the element 172 being of sufficient strength and durability to accommodate depletion of the cartridge 114 while generating a high quality foam.

Figure 5:
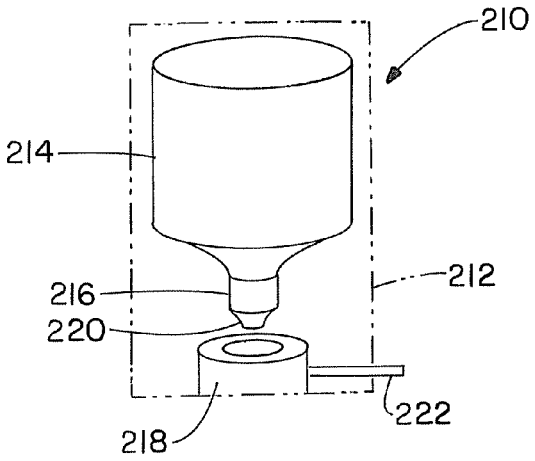
FIG. 5 is an illustrative functional view of a bifurcated stem foam pump made in accordance with embodiments of the present invention.

Referring now FIG. 5, another embodiment of a bifurcated foam pump assembly of the invention is designated generally by the numeral 210. It will be appreciated that the foam solution dispenser may be of any of various types, adapted for dispensing soap, lotion, sanitizers, cleaners or the like in the form of a foam. The dispenser 210 includes a housing 212, typically of molded plastic or the like. The housing 212 defines a cavity which is adapted to receive a bottle or cartridge 214 of liquid of the particular type required for generating the desired foam. The bottle or cartridge 214 is nestingly received by the housing 212 and may be received and contained by supporting brackets, collars and the like within the housing 212.

A liquid pump 216 is sealed to and provided as a portion of the disposable refill cartridge or bottle 214. In contradistinction, an air compressor unit 218 is provided as part and parcel of the dispenser housing 212. In a preferred embodiment of the invention, the liquid pump 216 includes a dispensing nozzle 220, through which the generated foam is dispensed onto the hand of the user, utensil or otherwise.

A suitable actuator 222, an integral part of the housing 212, is operatively connected to the air compressor 218 to achieve actuation of the foam generator comprising the combination of the liquid pump 216 and air compressor 218. Those skilled in the art will understand that foam is typically generated from a combination of air and liquid, with the two being forced together, agitated, stirred, forcefully blended or the like. The actuator 222 may be either manually actuated as in the case of a lever, push bar or the like, or it may be electronically or optically actuated as in the implementation of touch free dispensers.

It will be appreciated that a concept of the invention, and as particularly presented below, is the implementation and utilization of a bifurcated foam pump assembly, in which the liquid pump portion is sealingly attached to and made a portion of the disposable and replaceable cartridge 214 containing the liquid ingredient of the foam solution, while the air compressor 218 and associated nozzle 220 are not disposable, but remain a portion of the dispenser housing 212.

Figure 7:
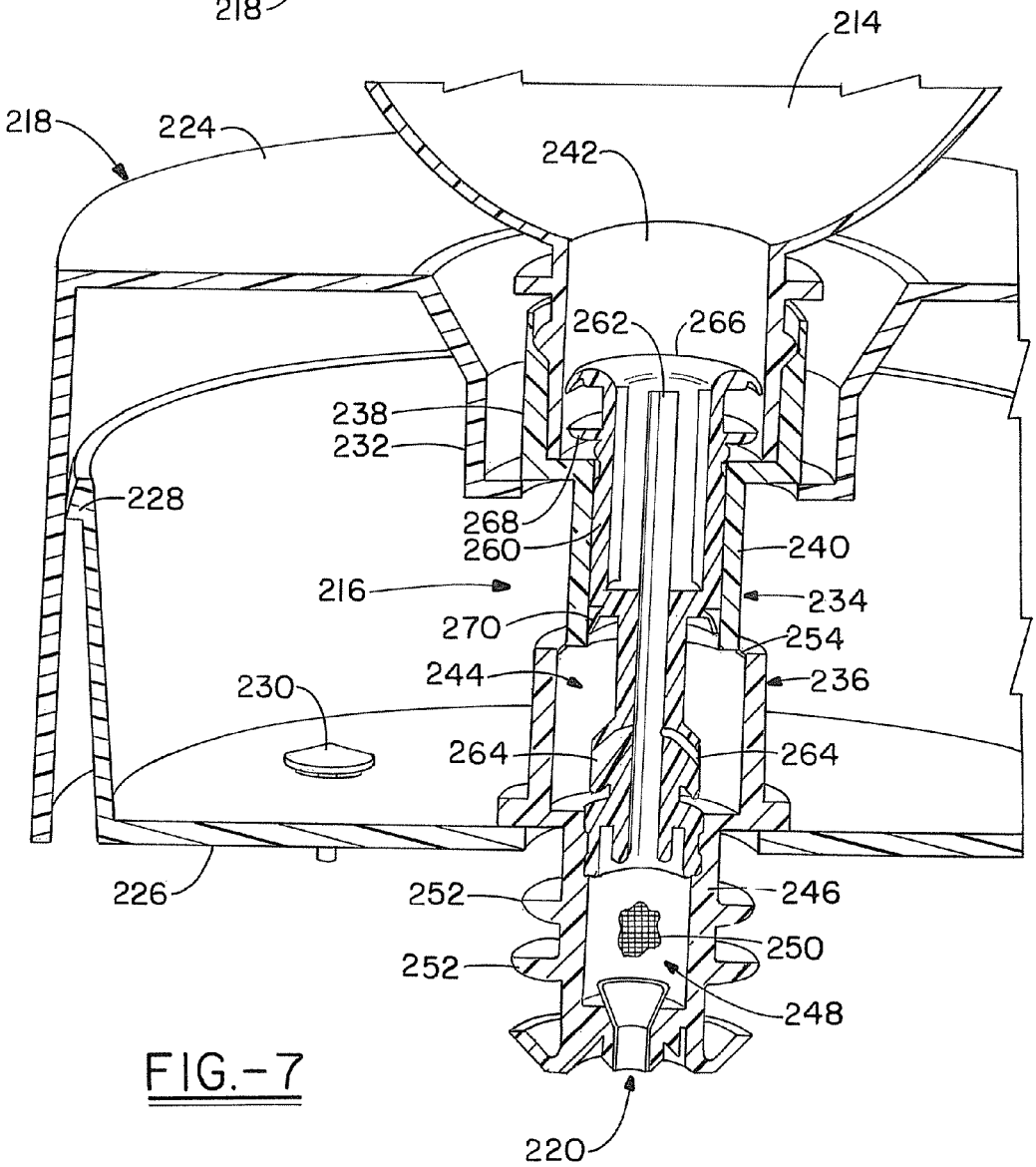
FIG. 7 is a partial sectional view of the foam pump assembly of FIG. 5, showing the hollow stem in cross section.
Figure 6:
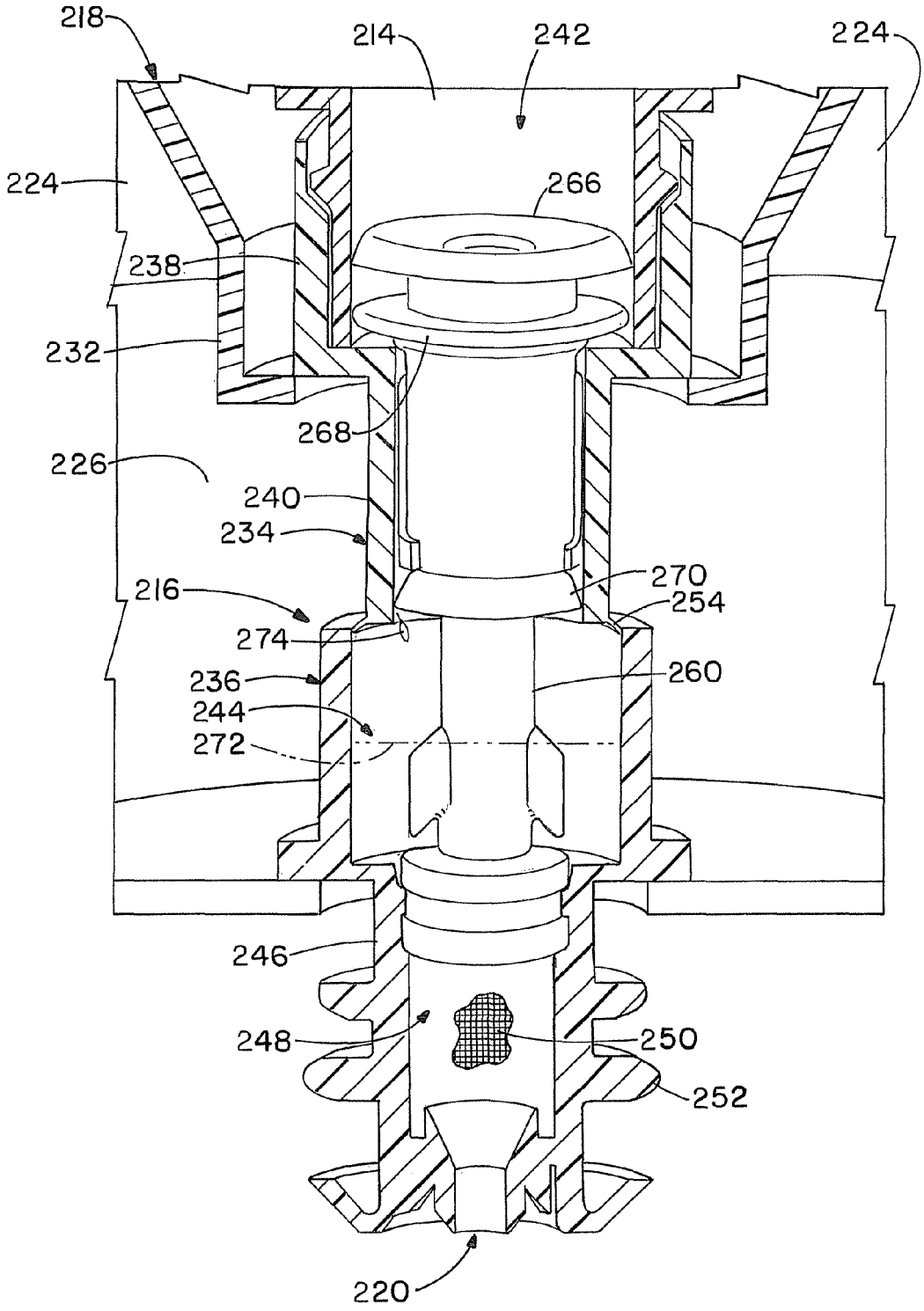
FIG. 6 is a partial sectional view of the foam pump of FIG. 5 in the "at rest" position.

Referring now to FIG. 6, the air compressor portion 218 of the invention includes a collar 224 receiving a piston 226 sealingly and reciprocatingly therein. The piston 226 is actuated by the actuator 222. A sealing ring 228 extends about an upper edge of the piston 226 in engagement with an interior surface of the cup-shaped collar 218, as best shown in FIG. 7. A one-way check valve 230 is provided in a bottom portion of the piston 226 for purposes of replenishing air within the air chamber defined between the piston 226 and collar 224. Further comprising a portion of the air compressor 218, a collar 232 extends centrally downwardly from the collar 224 and is adapted to receive the bottle or cartridge of liquid 214, having the liquid pump portion 216 of the invention attached thereto.

With continued reference to FIGS. 6 and 7, it can be seen that the liquid pump 216 includes an upper pump housing 234 and a lower pump housing 236, the two being reciprocatingly interengaged as will become apparent below. A collar 238 forms an upper portion of the upper pump housing 234 and is adapted to sealingly engage a neck of the cartridge 214. An upper sleeve portion 240 of the upper pump housing 234 extends downwardly from the collar 238, as shown. The collar 238, in association with the neck of the container 214, defines a first liquid reservoir in communication with the pump.

A second liquid reservoir 244 is defined by the lower pump housing 236 and includes a lower sleeve portion 246 that extends downwardly, ending at the nozzle 220. A cavity 248 is defined within the lower sleeve 246 and is adapted to receive a mesh, screen, sponge or the like 250 for purposes of generating foam from a combination of liquid and air imparted thereto. The sleeve 246 includes a collar 252 adapted for interengagement with the actuator 222. However, it will be appreciated that the actuator 222 may otherwise engage the pump, as will be readily understood by those skilled in the art.

A ring seal 254 extends about the lower end portion of the upper sleeve 240 of the upper pump housing 234, as illustrated. The ring seal 254 engages the inner wall of the lower pump housing 236 defining the second liquid reservoir 244.

A hollow stem 260 is received within and extends between the upper and lower pump housing sections 234, 236. A lower end of the hollow stem 260 is secured to the lower pump housing 236, as shown. The hollow stem 260 includes a central bore 262 that is closed at the top end thereof and that opens into the cavity 248 at the bottom thereof. Feeder passages 264 extend angularly upward to provide communication between the second liquid reservoir 244 and the central bore 262 of the hollow stem 260.

An upper ring seal 266 extends about the top end of the hollow stem 260, as shown. The upper ring seal 266 engages the inner wall surfaces of the first liquid reservoir 242 and serves as a wiper or seal between the hollow stem 260 and the walls of the cavity 242. A guide collar 268 extends circumferentially around the hollow stem 260 slightly below the upper ring seal 266 to ensure axial alignment within the reservoir 242.

A lower ring seal 270 extends about the hollow stem 260 and within the upper sleeve portion 240, making wiping sealing contacting engagement with the inner wall thereof. As shown in FIG. 6, the second liquid reservoir 244 maintains, in the standby condition, a reservoir of liquid at the level 272, just below the interconnection of the passageway 264 with the central bore 262 of the hollow stem 260. As will be appreciated below, the liquid is moved from the cartridge 214 and first liquid reservoir 242, through the sleeve 240, past the one-way valve lower ring seal 270 and into the second liquid reservoir 244. A liquid droplet 274 is shown in FIG. 6 passes from the sleeve 240, past the lower ring seal 270 and into the second liquid reservoir 244.

Figure 8:
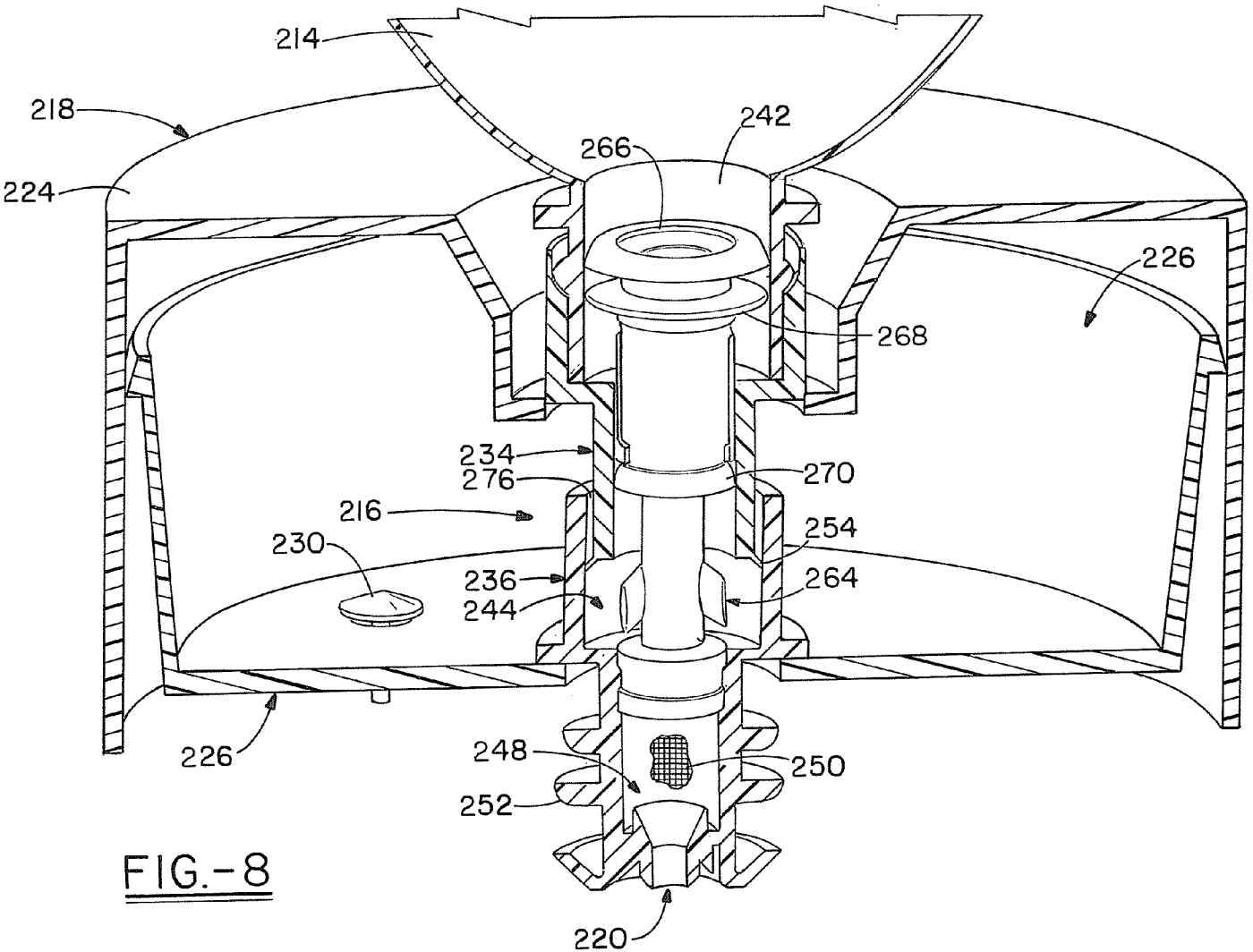
FIG. 8 is a partial sectional view of the stem foam pump structure of FIG. 5 showing the same in a position for foam generation.
Figure 9:
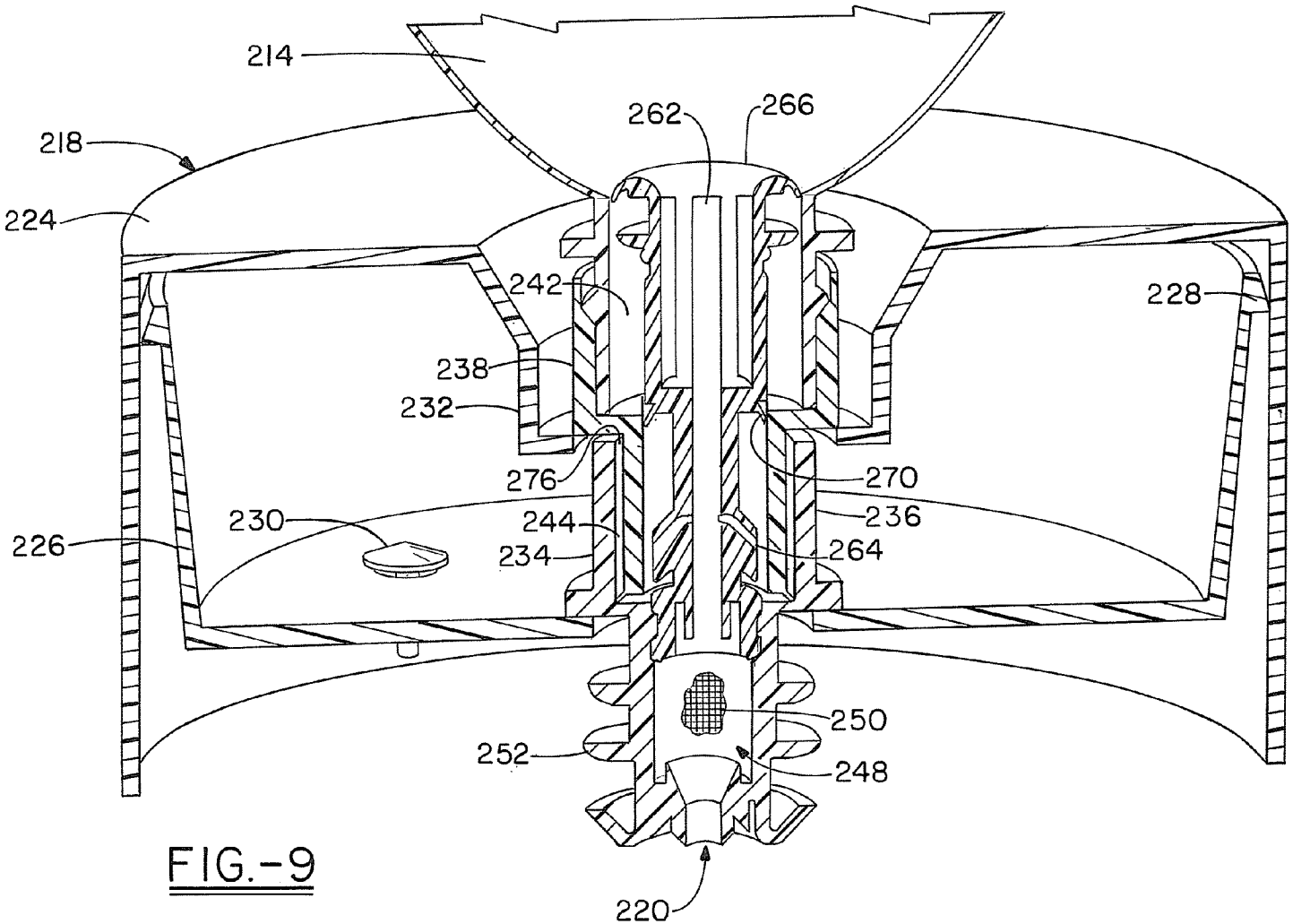
FIG. 9 is a partial sectional view of the stem foam pump of FIG. 5 showing the same in the fully extended activated position.

As best seen in FIGS. 8 and 9, there is a clearance between the sleeve 240 of the upper pump housing 234 and the lower pump housing 236 defining the reservoir 244. This allows for telescoping reciprocating movement between the upper and lower pump housing members 234, 236, and further accommodates the passage of air through the clearance 276 from the air chamber defined between the collar 224 and piston 226 and the second liquid reservoir 244 upon actuation of the pump.

It will be appreciated that a liquid pump portion 216, primarily comprising elements 234, 236 described above, is provided as part and parcel of the replaceable cartridge 214 and is adapted to be received by the air compressor 218, comprising elements 224-232, which are a fixed integral portion of the dispenser housing 212. Of course, appropriate seals are provided on the pump and air compressor mating portions to ensure leak-free operation, as to both liquid and air.

With an appreciation of the structure of the invention, an understanding of its operation can be obtained. FIGS. 6 and 7 illustrate the at-rest or standby position of the dispenser and foam pump assembly of the invention. At this point, a level of liquid 272 is maintained within the second liquid reservoir 244. Upon actuation of the actuator 222, the piston 226 compresses within the collar 224, compressing the air chamber defined therebetween, sealing the one-way check valve 230, and driving air through the clearance 276 between the upper and lower pump housing member 234, 236 and into the second liquid reservoir 244. Accordingly, both liquid and air are driven through the feeder passages 264 and into the central bore 262 of the hollow stem 260. The combination of air and liquid is then forced from the central bore 262 and into the cavity 248 maintaining an appropriate mesh, 250 screen, sponge or the like to extrude the combination of liquid and air into a foam that is emitted from the nozzle 220.

The pump is shown at its maximum compression in FIG. 9. Thereafter, a spring or other appropriate return mechanism that may be either provided interiorly between the collar 224 and piston 226, or as part and parcel of the actuator 222, causes return of the pump to its standby position. At the maximum extension shown in FIG. 9, liquid from the cartridge 214 passes by the lifted upper ring seal 260 and into the first liquid reservoir 242. As the return mechanism draws the hollow stem 260 downwardly between the pump housings 234, 236, the liquid within the first liquid reservoir 242 is driven past the lower ring seal 270, serving as a one-way valve. That liquid then replenishes the second liquid reservoir 244 to the level 272 shown in FIG. 6. During this operation, the one-way check valve 230 is opened by the vacuum created in the air chamber cavity between the collar 224 and piston 226, allowing air to replenish the air chamber. The pump is then available for a subsequent dispensing operation.

Thus, it can be appreciated that the aspects of the invention have been achieved by the structure presented above. The fluid pump of the invention can be a commonly available fluid pump requiring minimal modification. The fluid pump is sealingly fixedly attached to and remains a portion of the disposable liquid cartridge 214. Being a commonly known and readily available liquid pump, the cost of the disposable cartridge 214 is greatly reduced. Moreover, the air compressor portion of the foam generating assembly remains an integral part of the dispenser housing 212, further reducing refill and replacement costs.

While, in accordance with the patent statutes, only the best mode and preferred embodiments of the invention have been presented and described in detail, the invention is not limited thereto or thereby. Accordingly, for an appreciation of the true scope and breadth of the invention, reference should be made to the following claims.

The invention claimed is:

1. A refillable foam dispenser comprising:

a housing;

an air compressor connected to the housing;

an actuator connected to the housing for actuating the air compressor;

the air compressor having a cavity for receiving a refill unit that includes a container and a liquid pump;

the dispenser having an empty state and a refilled state;

the empty state occurring when no refill unit including a container and a liquid pump is positioned in the dispenser;

the refilled state occurring when a refill unit is positioned in the dispenser and the liquid pump is received by the air compressor;

wherein the air compressor remains connected to the housing during the refilled state and remains connected to the housing during the empty state.

2. The refillable foam dispenser of claim 1 further comprising a refill unit having a liquid pump secured to a container for containing a foamable liquid.

3. The refillable foam dispenser of claim 2 further comprising a first seal member located between the air compressor and the liquid pump when the dispenser is in a refilled state.

4. The refillable foam dispenser of claim 3 wherein the seal member is connected to the air compressor.

5. The refillable foam dispenser of claim 3 wherein the seal member is connected to the liquid pump.

6. The refillable foam dispenser of claim 3 wherein the liquid pump fits within an annular recess in the air compressor.

7. The refillable foam dispenser of claim 3 comprising a second seal member and wherein the first seal member and the second seal member at least partially form an air passageway during the refilled state.

8. The refillable foam dispenser of claim 1 further comprising:

a refill unit including:

a container for containing a foamable liquid;

a liquid pump housing connected to the container;

the liquid pump housing including a liquid reservoir;

an inlet valve located upstream of the liquid reservoir;

an outlet valve located downstream of the liquid reservoir;

a foaming screen located at least partially within the liquid pump housing; and a foam dispensing nozzle secured to the liquid pump housing;

the liquid pump housing configured to releasably mate with the air compressor;

the liquid pump housing having an air inlet passage, the air inlet passage being in fluid communication with the atmosphere without being in fluid communication with an air compressor prior to being placed in the foam dispenser and being in fluid communication with an air compressor when the refill unit is placed in the foam dispenser; and wherein the refill unit is configured to be removed from the foam pump dispenser without removing the air compressor from the foam pump dispenser.

9. The refillable foam dispenser of claim 8 wherein the air compressor is cylindrical and the liquid pump housing is cylindrical and fits at least partially within the cylindrical air compressor when the refill unit is located in the foam pump dispenser.

10. The refillable foam dispenser of claim 8 further comprising a sealing member secured to the pump housing for sealing against a wall of the air compressor.

11. The refillable foam dispenser of claim 8 wherein the liquid pump housing has a seal engagement member that engages a seal to form an air passageway when the refill unit is located in a foam pump dispenser.

12. A refillable foam dispenser comprising:

a housing;

an air compressor connected to the housing;

an actuator connected to the housing for actuating the air compressor;

the air compressor having a cavity for receiving a refill unit that includes a container and a liquid pump;

the dispenser having an empty state and a refilled state;

the empty state occurring when no refill unit including a container and a liquid pump is positioned in the dispenser;

the refilled state occurring when a refill unit is positioned in the dispenser and the liquid pump is received by the air compressor;

wherein the air compressor remains connected to the housing during the refilled state and remains connected to the housing during the empty state; and a refill unit including:

a container for containing a foamable liquid;

a liquid pump housing connected to the container;

the liquid pump housing including a liquid reservoir;

an inlet valve located upstream of the liquid reservoir;

an outlet valve located downstream of the liquid reservoir;

a foaming screen located at least partially within the liquid pump housing; and a foam dispensing nozzle secured to the liquid pump housing;

the liquid pump housing configured to releasably mate with the air compressor;

the liquid pump housing having an air inlet passage, the air inlet passage being in fluid communication with the atmosphere without being in fluid communication with an air compressor prior to being placed in the foam dispenser and being in fluid communication with an air compressor when the refill unit is placed in the foam dispenser;

wherein the refill unit is configured to be removed from the foam pump dispenser without removing the air compressor from the foam pump dispenser; and wherein the air inlet through the liquid pump housing is located in the liquid reservoir.

13. A refill unit for a refillable foam dispenser, the refillable foam dispenser having an air compressor attached thereto, the refill unit comprising:

a container for containing a foamable liquid;

a liquid pump housing connected to the container;

the liquid pump housing including a liquid reservoir;

an inlet valve located upstream of the liquid reservoir;

an outlet valve located downstream of the liquid reservoir;

an air inlet opening through the liquid pump housing;

a foaming screen located at least partially within the liquid pump housing, and a foam dispensing nozzle secured to the liquid pump housing;

the liquid pump housing configured to releasably mate with an air compressor that is not part of the refill unit but is secured to a foam pump dispenser housing, and the refill unit is configured to be removed from the foam dispenser without removing the air compressor from the foam dispenser;

wherein the air inlet passage is in fluid communication with the open atmosphere without being in fluid communication with an air compressor prior to being installed in a foam dispenser and the air inlet passage is in fluid communication with an air compressor when the refill unit is placed in the foam dispenser.

14. The refill unit of claim 13 wherein the liquid pump housing is cylindrical and has a seal engagement member that engages a seal to form an annular air passageway around at least a portion of the cylindrical pump housing when the refill unit is located in a foam pump dispenser.

15. The refill unit of claim 13 wherein the liquid pump housing includes a sealing member that contacts a wall of an air compressor when the refill unit is placed in the foam dispenser.

16. A refill unit for a refillable foam dispenser, the refillable foam dispenser having an air compressor attached thereto, the refill unit comprising:

a container for containing a foamable liquid;

a liquid pump housing connected to the container;

the liquid pump housing including a liquid reservoir;

an inlet valve located upstream of the liquid reservoir;

an outlet valve located downstream of the liquid reservoir;

an air inlet opening through the liquid pump housing;

a foaming screen located at least partially within the liquid pump housing, and a foam dispensing nozzle secured to the liquid pump housing;

the liquid pump housing configured to releasably mate with an air compressor that is not part of the refill unit but is secured to a foam pump dispenser housing, and the refill unit is configured to be removed from the foam dispenser without removing the air compressor from the foam dispenser;

wherein the air inlet passage is in fluid communication with the open atmosphere without being in fluid communication with an air compressor prior to being installed in a foam dispenser and the air inlet passage is in fluid communication with an air compressor when the refill unit is placed in the foam dispenser; and wherein the air inlet through the liquid pump housing is located in the liquid reservoir.

17. A refill unit for a refillable foam pump dispenser comprising:

a container for containing a foamable liquid;

a liquid pump housing connected to the container;

a liquid reservoir located within the liquid pump housing;

an inlet valve located upstream of the liquid reservoir;

an outlet valve located downstream of the liquid reservoir;

a foam screen located downstream of the liquid reservoir;

a foam outlet nozzle located downstream of the foam screen; and an air inlet through the liquid pump housing;

wherein the inlet is in fluid communication with the atmosphere without being in fluid communication with an air compressor prior to installation of the refill unit in a refillable foam dispenser, and the inlet is in fluid communication with an air compressor after being installed in the refillable foam dispenser.

18. The refill unit of claim 17 wherein the liquid pump housing is cylindrical and fits at least partially within a cylindrical air compressor when the refill unit is located in a foam pump dispenser.

19. The refill unit of claim 18 further comprising a sealing member secured to the pump housing for sealing against a wall of an air compressor that is not part of the refill unit.

20. The refill unit of claim 18 wherein the liquid pump housing has a seal engagement member that engages a seal to form an air passageway when the refill unit is located in a foam pump dispenser.

* * * * *